US006053481A

United States Patent [19]

Scheide

[11] Patent Number: 6,053,481

[45] Date of Patent: Apr. 25, 2000

[54] SECURITY FENCE RAIL BRACKET

[75] Inventor: James W. Scheide, Timonium, Md.

[73] Assignee: Security Fence Manufacturing & Supply Co., Inc., Bladensburg, Md.

[21] Appl. No.: 09/122,883

[22] Filed: Jul. 28, 1998

[51] Int. Cl.[7] ..... E04H 17/14

[52] U.S. Cl. ..... 256/65; 256/67; 256/DIG. 2

[58] Field of Search ..... 256/69, 68, 67, 256/65, 60, 59, 26, 27, 21, DIG. 2; 248/300, 218.4; 411/538, 537, 535, 536, 546

[56] References Cited

U.S. PATENT DOCUMENTS

| | | | |
|---|---|---|---|
| 646,314 | 3/1900 | Rites . | |
| 656,314 | 8/1900 | Beerbower . | |
| 3,233,871 | 2/1966 | Schroer . | |
| 3,285,568 | 11/1966 | Biach | 411/538 X |
| 4,074,893 | 2/1978 | Coltrin . | |
| 4,150,907 | 4/1979 | Thurnauer . | |
| 4,923,176 | 5/1990 | Heinz . | |
| 5,026,028 | 6/1991 | Ooi et al. . | |
| 5,186,571 | 2/1993 | Hentzschel | 256/65 |
| 5,190,268 | 3/1993 | Espinueva . | |
| 5,547,169 | 8/1996 | Russell | 256/67 |

*Primary Examiner*—Harry C. Kim
*Assistant Examiner*—Paco S. Freire
*Attorney, Agent, or Firm*—Shoemaker and Mattare, LTD

[57] ABSTRACT

A bracket for supporting a fence rail includes a hollow body having an open-topped cavity and an end wall with a cross-shaped aperture through which a bolt is passed into a fence post. The angularity of the body with respect to the post surface is adjusted by installing one or more tapered spacers between the body and the post. The spacers have nesting bosses and recesses, and offset slots through which the bolt passes. One surface of the end wall has a spherical shape so that the head of the bolt seats flat, regardless of the angularity which has been established.

9 Claims, 6 Drawing Sheets

SECURITY FENCE RAIL BRACKET

BACKGROUND OF THE INVENTION

This invention relates to a universal fence rail bracket. A universal bracket, mounted on a fence post, can be used to support non-horizontal rails, and rails which are not in the same vertical plane as neighboring rails, for example, where the fence line is a curve.

Some prior inventors have addressed the problem of providing universal positioning of fence rails or posts. See, for example, U.S. Pat. Nos. 646,314, 3,233,871, 4,0748,93, 4,150,907, 4,923,176, 5,026,028, 5,190,268, and 5,547,169. The last-mentioned patent discloses a fence rail bracket having a rounded depression which receives the rounded end of a body member that supports the end of a rail, thus providing limited universal movement during installation.

SUMMARY OF THE INVENTION

An object of the invention is to enable one to construct a fence quickly, and to permit non-perpendicular post-rail connections without sacrificing the strength and security of the fence.

These and other objects are met by a security fence rail bracket including a hollow body having an open-topped cavity and an end wall with a cross-shaped aperture through which a bolt is passed into a fence post. The angularity of the body with respect to the post surface is adjusted by installing one or more tapered spacers between the body and the post. The spacers have nesting bosses and recesses to maintain their alignment, and offset slots through which the bolt passes. One surface of the end wall has a spherical shape so that the head of the bolt seats flat against that surface, regardless of the angularity which has been established.

BRIEF DESCRIPTION OF THE DRAWINGS

In the accompanying drawings.

DESCRIPTION OF THE PREFERRED EMBODIMENT

Figure 1:
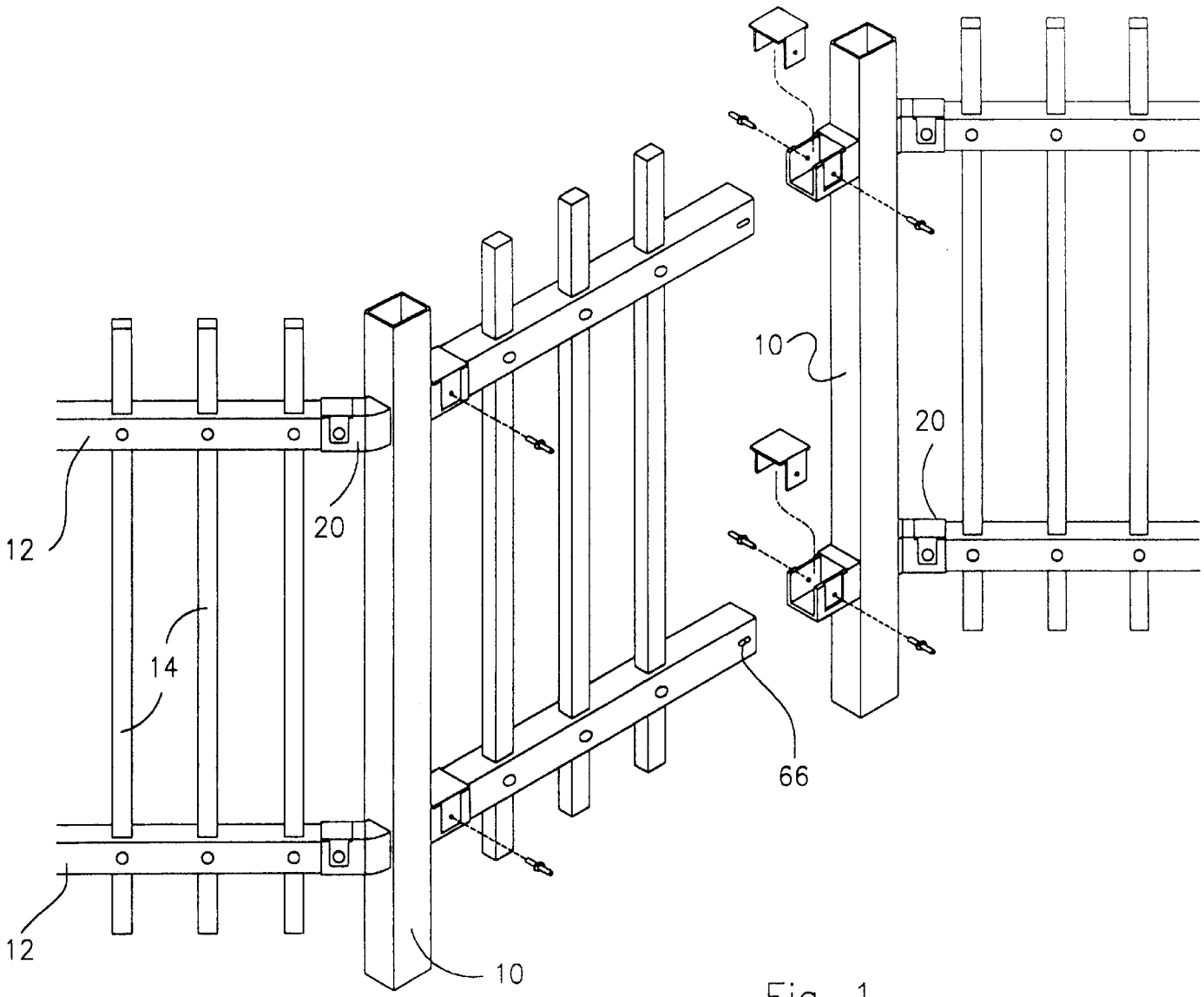
FIG. 1 is a perspective view, from the front and above, of a picket fence having security fence rail brackets embodying the invention.

The fence shown in FIG. 1 comprises a series of posts 10 interconnected by two or more rails 12, which in turn support a series of vertical pickets 14. The pickets are not a necessary part of this invention, which is directed only to the post-rail connection.

Each rail is supported at either end on a post by means of a bracket. At least some of the brackets in the fence line may be universal brackets 20 embodying the invention. The universal brackets enable one to connect the rails to the posts where the rails must be non-perpendicular to the lateral face of the post. Such conditions occur on slopes, where the rails are non-horizontal, and where the fence line deviates so that rails on either side of the post, are not collinear.

Figure 2:
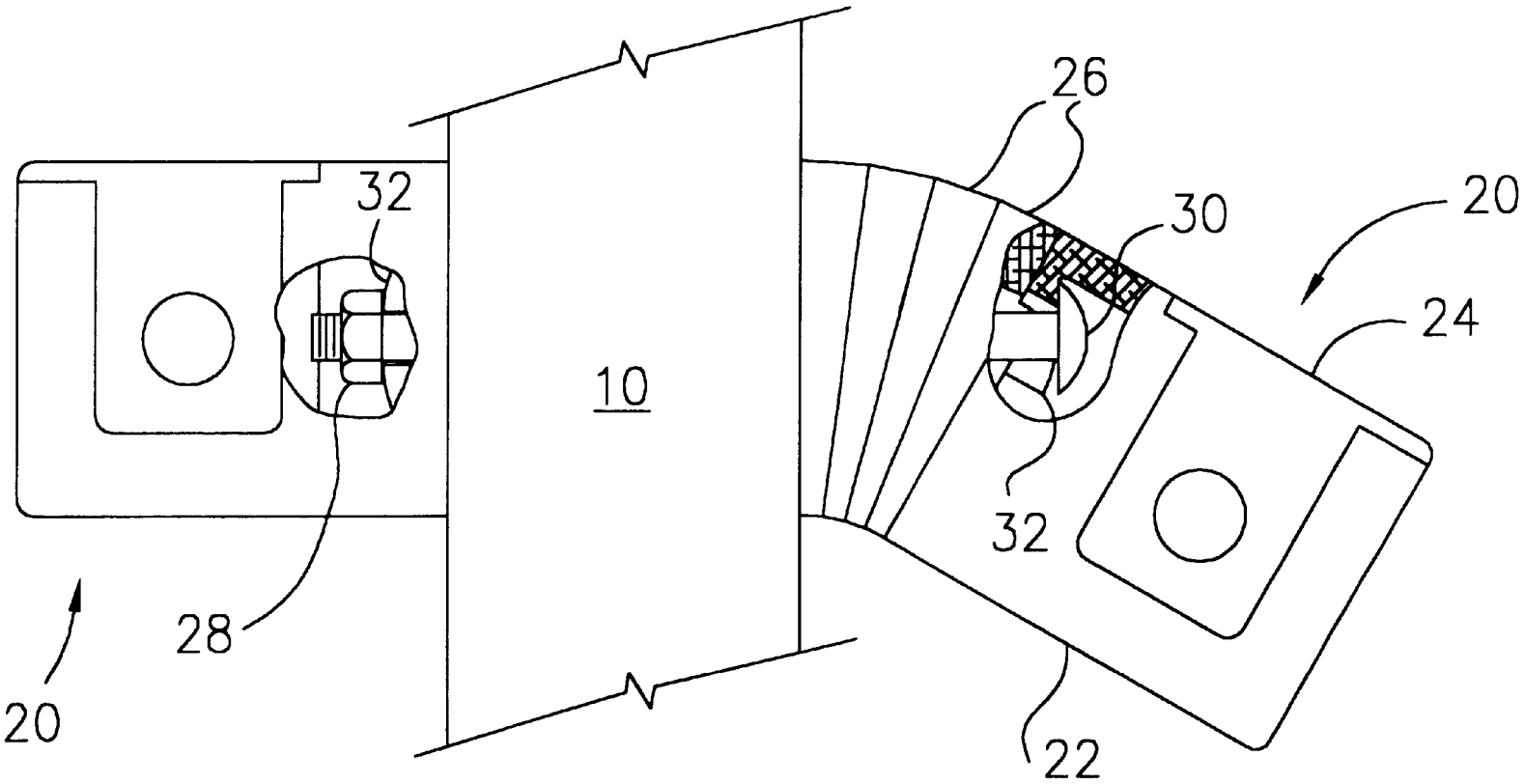
FIG. 2 is a front elevation of a portion of the fence, showing one post and two brackets embodying the invention, attached to the post.
Figure 3A:
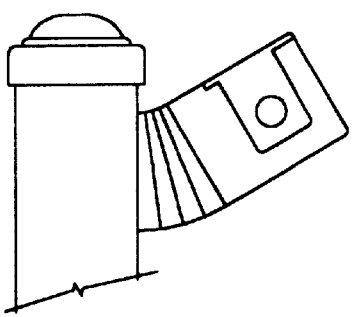
FIGS. 3*a*–3*f* show different settings of the bracket.
Figure 3B:
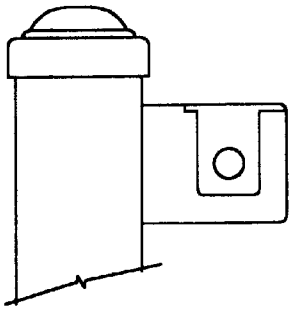
Figure 3C:
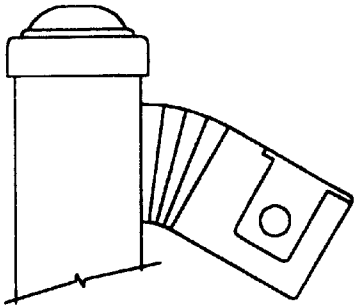
Figure 3D:
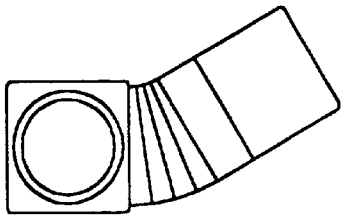
Figure 3E:
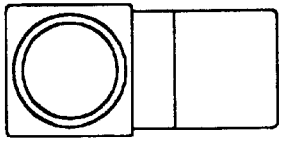
Figure 3F:
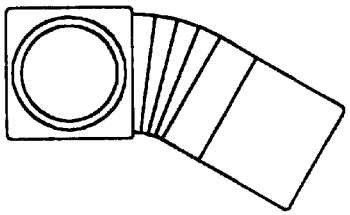
Figure 4A:
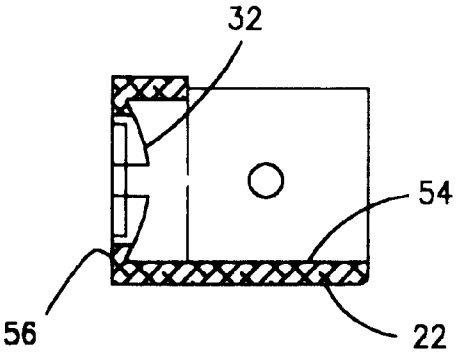
FIGS. 4*a*–4*f* show details of a portion of the bracket which receives the end of a fence rail.
Figure 4B:
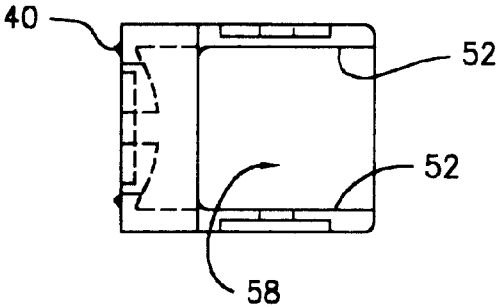
Figure 4C:
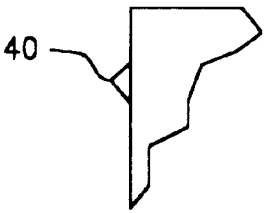
Figure 4D:
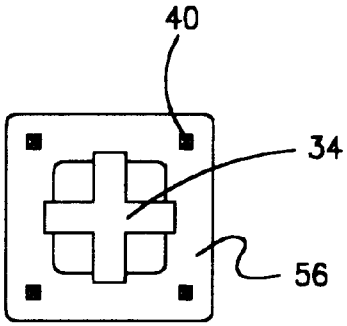
Figure 4E:
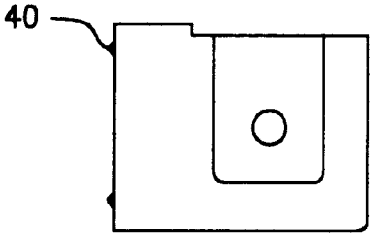
Figure 4F:
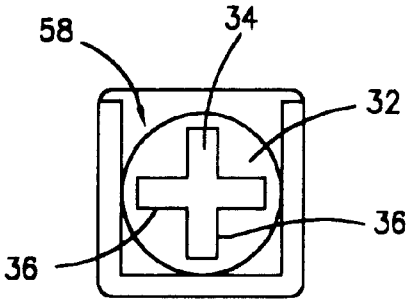
Figure 5E:
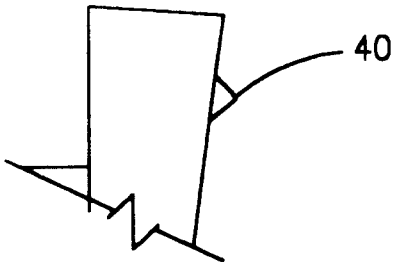
FIGS. 5*a*–5*e* show details of one tapered shim which is used to alter the angle of the bracket with respect to the post.
Figure 5C:
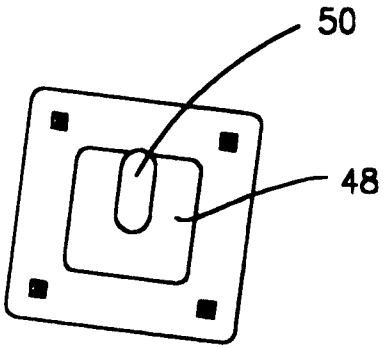
Figure 5D:
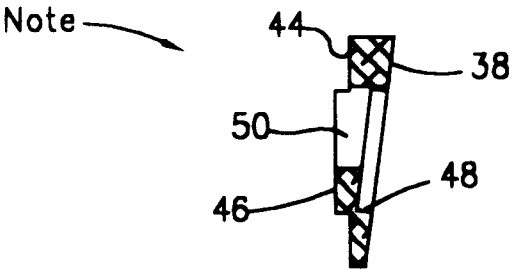
Figure 5B:
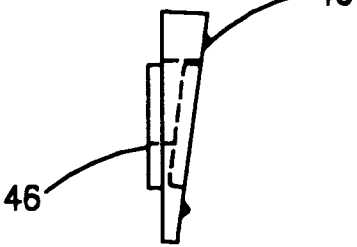
Figure 5A:
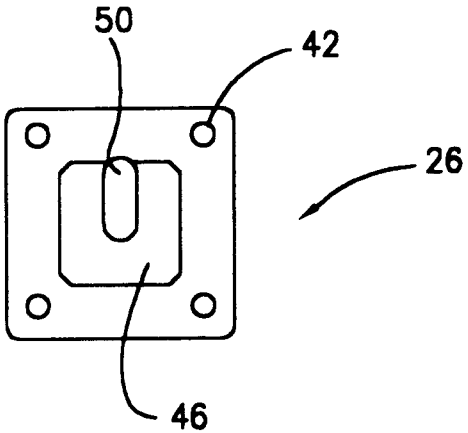

Two brackets 20 embodying the invention appear in FIG. 2. Each bracket comprises a main body 22, a cover 24, and, optionally, one or more tapered spacers or shims 26. The bracket on the right in FIG. 2 has four such spacers, so that the bracket of the body is directed downward. One may assume the ground slopes off to the right of the post at about the same angle as the bracket. The bracket on the left of the post has no spacers, and therefore extends perpendicular to its left face (presumably, the ground to the left of the post is level). The figure is broken away to reveal a nut 28 and a bolt 30 extending through the post, between the brackets. The head of the bolt, to the right, and the face of the nut, to the left, engage convex surfaces 32 on the inside of the body 22. The convex surface 32 is best seen in FIGS. 4*a* and 4*f*, the latter being a view into the body of the bracket, looking toward the post. The surface 32 is a segment of a sphere, interrupted by a cross-shaped through hole 34 whose arms 36 are wide enough to receive the shank of the bolt 30. The vertical and horizontal arms permit the bolt to deviate from center at angles of up to 30° from the horizontal direction perpendicular to the post face.

The angularity of the body with respect to the fence post surface is regulated by adding one or more tapered spacers 26, one of which is shown in FIGS. 5*a*–5*e*. The spacer shown has a 7½° taper angle, so that four spacers together, in similar alignment, produce a total deviation of 30°. To provide spacers with a different taper angle, or sets of spacers with different taper angles, would be a matter of design choice. By changing the alignment of the spacers, one changes the direction of deviation, as illustrated in FIGS. 3*a*–3*f*.

Each spacer has a first side 38 which is substantially flat, except for four protruding points 40 intended to dig into the post surface, or to seat within detents 42 on a second side 44 of a neighboring spacer. A square center portion of the second side is raised, forming a boss 46 which seats in a correspondingly shaped recess 48 in the first side of the spacer. The spacers thus nest when assembled, so that lateral slippage and relative rotation of the spacers with respect to one another cannot occur. A slot 50 through the center portion of the spacer permits insertion of the bolt 30. The slot is offset toward the thicker edge of the spacer, since the bolt will pass to that side of center, as one can best see in FIG. 2.

As shown in FIG. 4*a*, the bracket body includes two side walls 52, a bottom 54 and an end wall 56. The convex surface 32 is the inner face of the end wall. The opposite end, and the top, of the cavity 58 between the side walls are open, to receive the end of a rail 12.

Figure 6B:
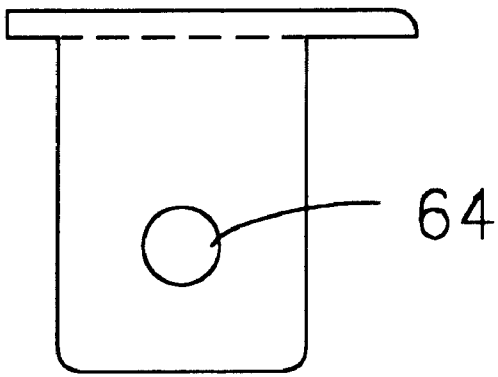
FIGS. 6*a* and 6*b* show a cover, in end and side elevations respectively, which secures the fence rail within the bracket.
Figure 6A:
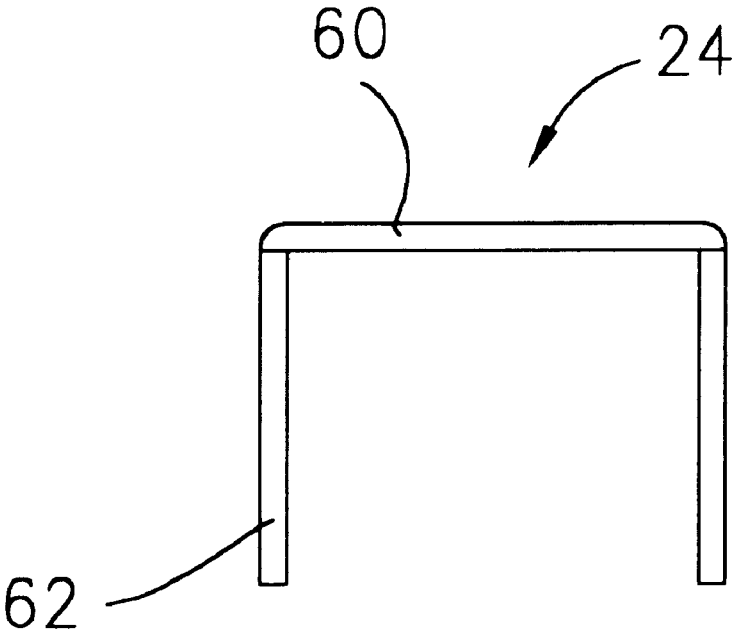

The cover 24 shown in FIGS. 6*a* and 6*b* includes a top panel 60 and two vertical wings 62, each of which has a hole 64 for receiving a fastener.

To construct a fence including the invention, the fence line is surveyed and the position of the posts is marked. Posts are then set in the ground, and the desired height of the rails is marked on each post. Bolt holes are drilled through the posts at these locations, and brackets 20 are installed on either side of the post, by passing a bolt 30 through the cross-shaped hole 34 in the bracket, the hole in the post, and the hole 34 in the bracket on the other side. A nut 28 is then threaded onto the end of the bolt and tightened, drawing the points 40 into the adjacent material. Now the ends of the rails 12 of a section of fence are dropped into the cavities 58 in the brackets, through their open tops. Finally, a cover 24 is placed over the end of the rail, and is secured by installing rivets through the holes 64 into holes 66 (FIG. 1) in the rails to prevent subsequent removal of the fence section.

Since the invention is subject to modifications and variations, it is intended that the foregoing description and the accompanying drawings shall be interpreted as only illustrative of the invention defined by the following claims.

I claim:

1. A bracket for connecting the end of a fence rail to a surface of a fence post, the bracket comprising a body having a cavity for receiving an end of the rail, one or more tapered spacers adapted for placement between the body and the post surface to adjust the angle of the body with respect to the post surface, and a bolt adapted to be inserted into the post and having a head for engaging the body and pulling the body toward the post, wherein the cavity in the body has two sides and an end wall, and the end wall has an aperture through which the bolt extends, but through which the head of the bolt cannot pass, said aperture being a cross-shaped slot having four arms, whereby the bolt can deviate from the center of the body in any of four directions.

2. The invention of claim 1, wherein each spacer has an aperture through which the bolt extends.

3. The invention of claim 2, wherein each aperture is a slot.

4. The invention of claim 3, wherein each spacer has a thicker edge and a thinner edge, and each slot is offset toward the thicker edge.

5. The invention of claim 1, wherein the end wall has a spherical surface on its side facing the cavity, whereby the head of the bolt bears flat against the edges of the slot regardless of the angularity of the body with respect to the post surface.

6. The invention of claim 1, wherein the cavity has an open top, so that the rail can be dropped into the cavity once the body has been attached to the post, and further comprising a cover attachable to the body so as to prevent the rail from being dislodged from the cavity.

7. A bracket for connecting the end of a fence rail to a surface of a fence post, the bracket comprising a body having a cavity for receiving an end of the rail, one or more tapered spacers adapted for placement between the body and the post surface to adjust the angle of the body with respect to the post surface, and a bolt adapted to be inserted into the post and having a head for engaging the body and pulling the body toward the post, wherein each spacer has a first side with a recess formed therein and a second side with a boss protruding therefrom, the boss and the recess having similar shapes to prevent lateral movement of said spacers when stacked together.

8. The invention of claim 7, wherein the shape of the boss and the recess is polygonal, so that the spacers cannot rotate with respect to one another.

9. The invention of claim 7, further comprising a plurality of points protruding from the first side of the spacer, to dig into the post surface, and a like plurality of recesses on the second side of the spacer, to receive the points of an adjacent spacer.

* * * * *